US007152743B2

(12) United States Patent
Johnson et al.

(10) Patent No.: US 7,152,743 B2
(45) Date of Patent: Dec. 26, 2006

(54) SCREENING PANEL SECURING SYSTEM

(75) Inventors: Leslie Ronald Johnson, Charlestown (AU); John William Eeles, Eleebana (AU); Peter Martin Olsen, Toronto (AU)

(73) Assignee: Weatherford International, Inc., Houston, TX (US)

( * ) Notice: Subject to any disclaimer, the term of this patent is extended or adjusted under 35 U.S.C. 154(b) by 0 days.

(21) Appl. No.: 10/493,517

(22) PCT Filed: Dec. 10, 2002

(86) PCT No.: PCT/AU02/01668

§ 371 (c)(1),
(2), (4) Date: Sep. 20, 2004

(87) PCT Pub. No.: WO03/051536

PCT Pub. Date: Jun. 26, 2003

(65) Prior Publication Data

US 2005/0016902 A1 Jan. 27, 2005

(30) Foreign Application Priority Data

Dec. 18, 2001 (AU) ..... PR 9592

(51) Int. Cl.
*B07B 1/49* (2006.01)

(52) U.S. Cl. ..... 209/405; 209/399; 209/395; 209/403

(58) Field of Classification Search ..... 209/403, 209/405, 399, 319; 403/408.1
See application file for complete search history.

(56) References Cited

U.S. PATENT DOCUMENTS

| | | | | |
|---|---|---|---|---|
| 4,670,136 | A | 6/1987 | Schmidt et al. | 209/403 |
| 5,361,911 | A * | 11/1994 | Waites et al. | 209/399 |
| 5,377,846 | A * | 1/1995 | Askew | 209/405 |
| 6,253,926 | B1 * | 7/2001 | Woodgate | 209/399 |

FOREIGN PATENT DOCUMENTS

AU A-62147/96 6/1997

OTHER PUBLICATIONS

International Search Report of Jan. 28, 2003 from Australian Patent Office.

* cited by examiner

*Primary Examiner*—Kathy Matecki
*Assistant Examiner*—Terrell Matthews
(74) *Attorney, Agent, or Firm*—Greenberg Traurig LLP

(57) ABSTRACT

A screening assembly 10 includes at least one rail 14 to be secured to a support member of a screening machine. At least one locating formation 16 extends from an operatively upper surface of the rail 14. Each locating formation 16 includes a catch member 32. The assembly 10 further includes a plurality of screening modules 12, each screening module 12 having an end supported on the rail 14. A pair of modules 12 lie in end-to-end abutting relationship with the abutting ends overlying the rail 14 so that the catch member 32 of each locating formation 16 protrudes beyond an upper surface of the screening modules 12. Further, a locking member 18 engages the catch member 32 of the locating formation 16 for locking the pair of modules 12 with respect to each other and with respect to the rail 14.

28 Claims, 8 Drawing Sheets

SCREENING PANEL SECURING SYSTEM

FIELD OF THE INVENTION

This invention relates to screening systems. More particularly, the invention relates to the securing of screening panels to a screening machine.

More specifically, the invention relates to a screening assembly and to components for a screening assembly.

SUMMARY OF THE INVENTION

According to a first aspect of the invention, there is provided a screening assembly which includes:

at least one rail to be secured, in use, to a support member of a screening machine to lie intermediate and parallel to side members of the screening machine;

at least one locating formation extending from an operatively upper surface of said at least one rail, the at least one locating formation including a catch member;

a plurality of screening modules, each screening module having an end supported on the at least one rail, a pair of modules lying in end-to-end abutting relationship with the abutting ends overlying the at least one rail so that at least the catch member of said locating formation protrudes beyond an upper surface of the screening modules; and a locking member associated with the at least one locating formation for engaging the catch member of said locating formation for locking the pair of modules with respect to each other and with respect to the rail.

Each rail may be in the form of a length of hollow box-section beam with a longitudinally extending slot defined in an operatively lower face of the beam. Thus, the beam may define a channel in which a head of a fastening means is slidably received for securing the rail to an underlying sub-frame of the screening machine. It will be appreciated that, with this arrangement, a universal-type rail is provided which can be used with different types of screening machines where the spacing or pitch between openings for the fastening means differs from machine to machine.

The beam may have a coating of a plastics material. The plastics coating may have a pair of spaced, parallel, longitudinally extending grooves defined in an operatively upper surface. Each end of each module may have a bead extending along an operatively lower surface, the bead, in use, being received in one of the grooves for effecting lateral location of the module relative to the rail.

Each locating formation may be in the form of a plate or plate-like structure which extends upwardly from an operatively upper surface of the rail. Each plate-like structure may also be coated with a synthetic plastics material. The plastics material coating the beam and the plate-like structure may be a polyurethane material.

The catch member of each locating formation may be formed in a free end of the plate-like structure.

In one embodiment of the invention, each locating formation may be arranged on its associated rail with longer sides of the plate-like structure extending parallel to a direction of flow of material over the screening modules. Instead, in another embodiment of the invention, the plate-like structure of each locating formation may be arranged at substantially right angles to a direction of flow of material over the screening modules. In the latter case, each screening module may have at least two locating formations associated with each end and a single locking member, which has a length substantially the same as that of each end of the screening module, may engage both locating formations.

The catch member of each locating formation may be substantially hook-shaped. The catch member may be in the form of a hook having a downwardly extending tip for engaging a complementary locking formation of the locking member to effect positive locking of the screening modules to the rail. Instead, the catch member may have a substantially curved, cam-like shape which engages a similarly curved, but oppositely directed, cam-like locking formation of the locking member to effect positive locking of the screening modules to the rail.

The locking member may include a body member which, conveniently, is of a metal-reinforced plastics material.

In the case of the first embodiment of the invention, where each locating formation has a locking member associated with it, an upstream end (when viewed in a direction of flow of material) of the locking member may be rounded to act as a deflector for deflecting the material to be screened. A slot may open out into a downstream end of the locking member into which the catch member of the locating formation is received to enable the catch member to engage the complementary locking formation of the locking member. In so doing, positive locking of the screening modules to the rails is facilitated.

In the second embodiment of the invention, where the locating formations are arranged at right angles to the direction of flow of material and one locking member is associated with at least two locating formations, the slots may open out into a side of the locking member so that the locking member is slid into position relative to the locating formations in a direction at right angles to the direction of flow of material over the screening modules.

An operatively lower peripheral edge of each locking member may have a slightly outwardly flared portion which acts as a skirt and bears against upper surfaces of the associated screening modules for inhibiting the ingress of detritus between the bottom of the locking member and the upper surfaces of the modules.

Each screening module may be substantially rectangular when viewed in plan and shorter sides of the screening modules may, in use, be arranged in the direction of flow of material over the screening modules. The ends of the screening modules may thus be the shorter sides of the screening modules which are received over their associated rails, each end of each screening module defining a part of at least one recess so that when the two modules abut end-to-end, at least one completed passage is formed through which an associated formation passes. The passage may be shaped to accommodate its associated locating formation as a snug fit therein.

The modules may be of a synthetic plastics material, suitably reinforced. Once again, the plastics material from which the modules are made may be polyurethane. The hardness of the polyurethane used for the locking member may differ from that of the modules for inhibiting binding of the locking member relative to its associated modules. Typically, the locking member may be of a harder polyurethane than the modules.

According to a second aspect of the invention, there is provided a screening module for a screening assembly, the screening module including:

a body member having a pair of opposed ends;

a part of at least one rectangular recess defined in at least one of the ends of the body member, the part of the rectangular recess, in use, mating with a corresponding part of a rectangular recess of a body member of an identical module arranged in end-to-end abutment to define a rectangular passage through which a locating formation of the screening assembly passes; and a locating means arranged along an operatively lower surface of at least one of the ends of the body member, the locating means being received in a complementary formation of an underlying rail of the screening assembly, in use, for locating the module with respect to the rail.

Each end of the body member may be stepped at its lower edge to overlie the rail of the screening assembly. The locating means may be arranged intermediate an end of the body member and an operatively vertical part of the step.

According to a third aspect of the invention, there is provided an intermediate rail for a screening assembly, the intermediate rail including:

a hollow, elongate element to be secured to an underlying support member of a screening machine by a plurality of spaced fasteners, the elongate element having a longitudinally extending slot defined in a surface thereof so that heads of the fasteners can be received within the elongate element with shanks of the fasteners protruding through the slots; and at least one locating formation standing proud of an operatively upper surface of the elongate element, the, or each, locating formation including a catch member.

The elongate element and the at least one locating formation may be covered with a synthetic plastics material.

According to a fourth aspect of the invention, there is provided a locking member for a screening assembly, the locking member including:

a body member having at least one open ended slot defined therein; and a locking formation arranged in the at least one slot to be engaged, by a catch member of a locating formation of the screening assembly when the catch member is received in the slot, in use.

BRIEF DESCRIPTION OF THE DRAWINGS

The invention is now described by way of example with reference to the accompanying drawings in which.

DETAILED DESCRIPTION OF THE DRAWINGS

Figure 1:
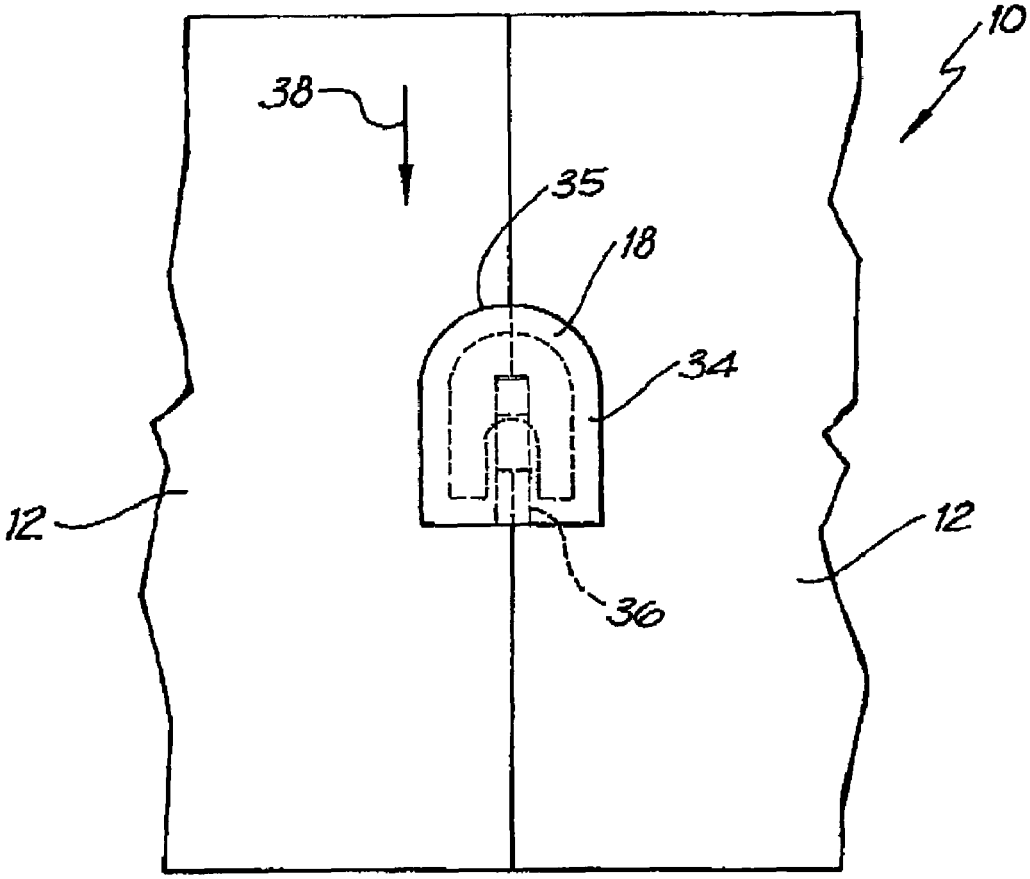
FIG. 1 shows a schematic plan view of a screening assembly in accordance with a first example of a first embodiment of the invention.

In the drawings, reference numeral 10 generally designates a screening assembly, in accordance with the invention. The assembly 10 comprises a plurality of screening modules 12, a pair of which is shown in FIGS. 1, 5, 9, 11 and 13 of the drawings. The pair of modules 12 is shown in abutting end-to-end relationship. It is to be noted in FIGS. 1, 5, 9, 11 and 13 that screening apertures of the screening modules 12 are omitted for the sake of clarity. The screening modules 12 are mounted on a sub-frame (not shown) of a screening machine (also not shown). The sub-frame and the screening machine are well known in the art and are not described in any detail below.

Figure 3:
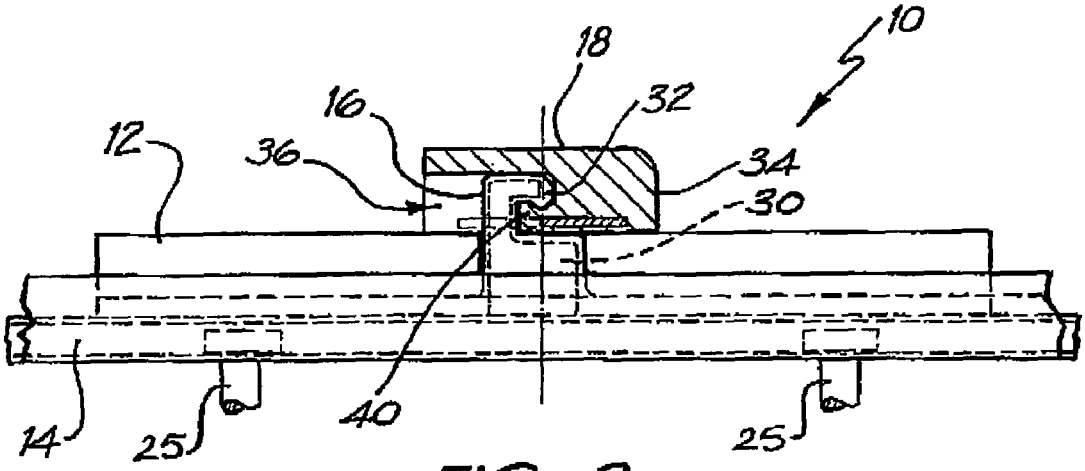
FIG. 3 shows a schematic side view of the assembly of FIG. 1.
Figure 4:
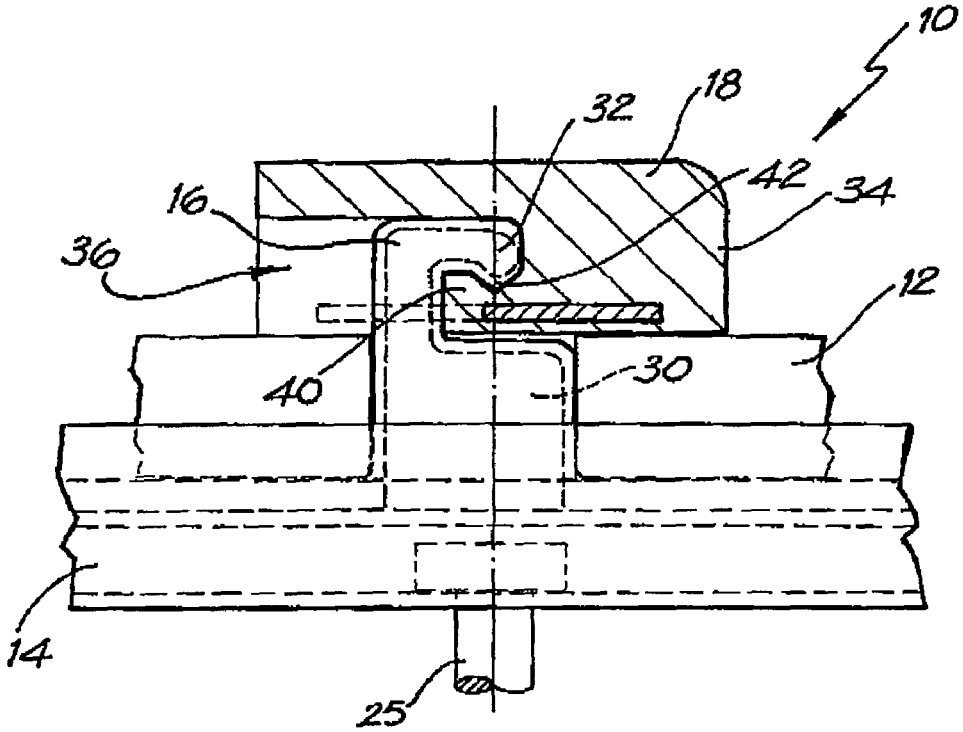
FIG. 4 shows, on an enlarged scale, part of a side view of the assembly of FIG. 1.
Figure 5:
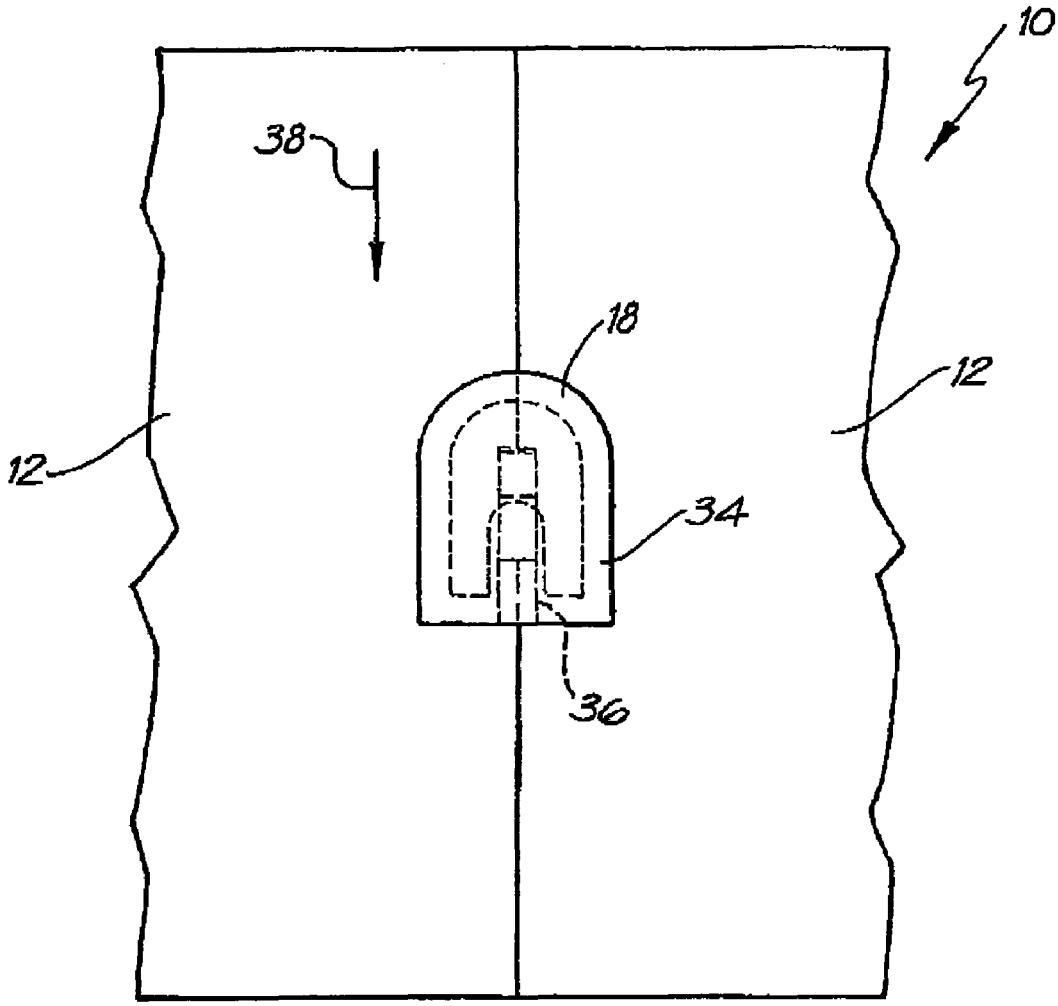
FIG. 5 shows a schematic plan view of a screening assembly in accordance with a second example of the first embodiment of the invention.
Figure 6:
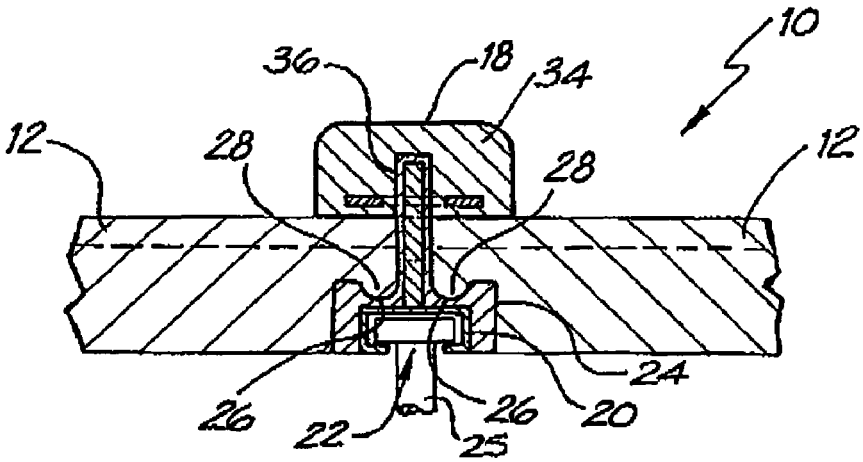
FIG. 6 shows a schematic end view of the assembly of FIG. 5.

The modules 12 are secured to the sub-frame of the machine in end-to-end abutting relationship by means of intermediate rails, one of which is shown, for example, at 14 in FIG. 3 of the drawings. The sub-frame of the screening machine comprises a plurality of members extending in spaced, parallel relationship between two sides of the screening machine. Each member of the sub-frame supports an intermediate rail 14 thereon as does each side of the screening machine.

FIGS. 1–4 of the drawings show a first example of a first embodiment of the invention. In this example, abutting ends of the modules 12 are secured to their associated rail 14 by a single locating formation 16 and its associated locking member 18.

Figure 2:
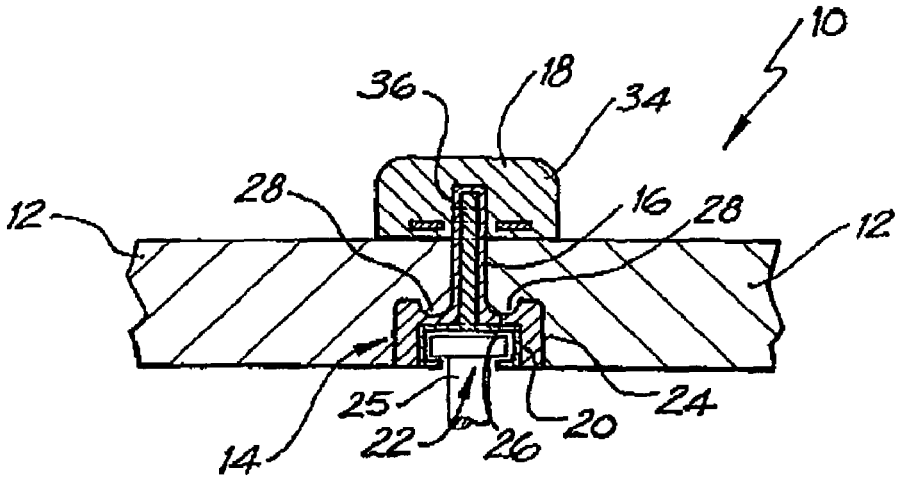
FIG. 2 shows a schematic end view of the assembly of FIG. 1.

As illustrated more clearly in FIG. 2 of the drawings, each intermediate rail 14 is formed from a length of hollow box section beam 20 with a longitudinally extending slot 22 formed in an operatively bottom face of the beam 20. The beam 20 is covered by a coating 24 of a synthetic plastics material. The beam 20 facilitates securing of the rail 14 to any screening machine as the rail 14 does not have fasteners arranged at a fixed pitch. Instead, a head of a fastener 25 can be inserted into the beam 20 and is slidable relative to the beam 20 so that the rail 14 can be mounted on different makes of screening machines thereby improving the versatility of the assembly 10.

The plastics coating 24 is, conveniently, a polyurethane material. On each side of a longitudinal axis of the rail 14, a groove 26 is formed in the coating 24. A bead or rib 28 at an end of each module 12 is received in one of the grooves 26 for locating the module 12 laterally with respect to the rail 14.

Each locating formation 16 includes a plate-like structure 30 which stands proud of an upper surface of the rail 14. A catch member 32 is arranged at a free end of the plate-like structure 30. The plate-like structure 30 is also coated with the coating 24 of polyurethane material as is the catch member 32.

The locking member 18 includes a metal reinforced plastics body member 34. A slot 36 opens out into an operatively downstream end (when viewed in a direction of flow of material to be screened over the modules 12, as illustrated by arrow 38 in FIG. 1 of the drawings) of the body member 34. An upstream end 35 of the body member 34 of the locking member 18 has a curved shape to act as a deflector for deflecting the material to be screened away from the locking members 18.

The locking member 18 includes a locking formation 40 which projects into the slot 36 and engages the catch member 32 of the locating formation 16.

In the example of the first embodiment of the screening assembly 10 illustrated in FIGS. 1 to 4 of the drawings, the catch member 32 is in the form of a hook having a downwardly extending tip 42. The locking formation 40 of the locking member 18 is correspondingly shaped to clip under the tip 42 of the catch member 32 to effect positive locking of the modules 12 relative to the rail 14 in a vertical direction perpendicular to the flow of material.

Figure 7:
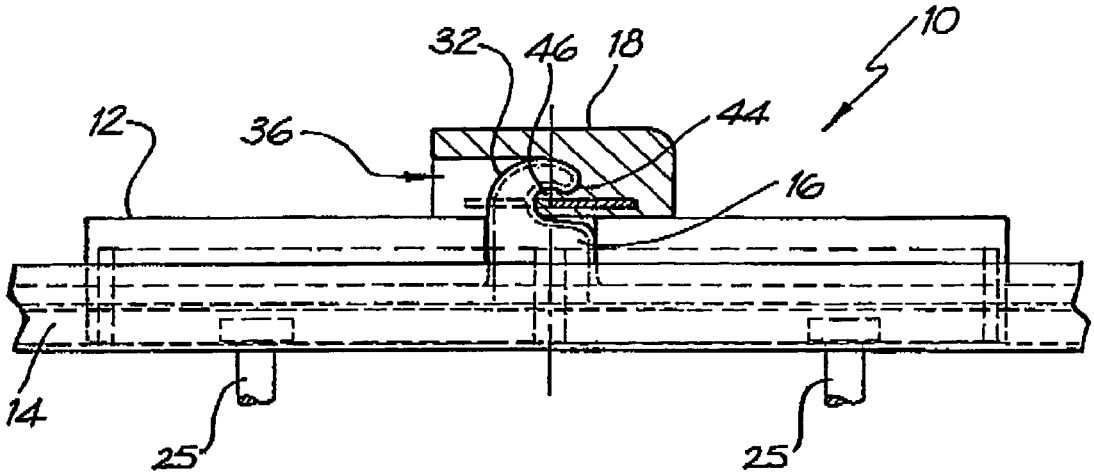
FIG. 7 shows a schematic side view of the assembly of FIG. 5.
Figure 8:
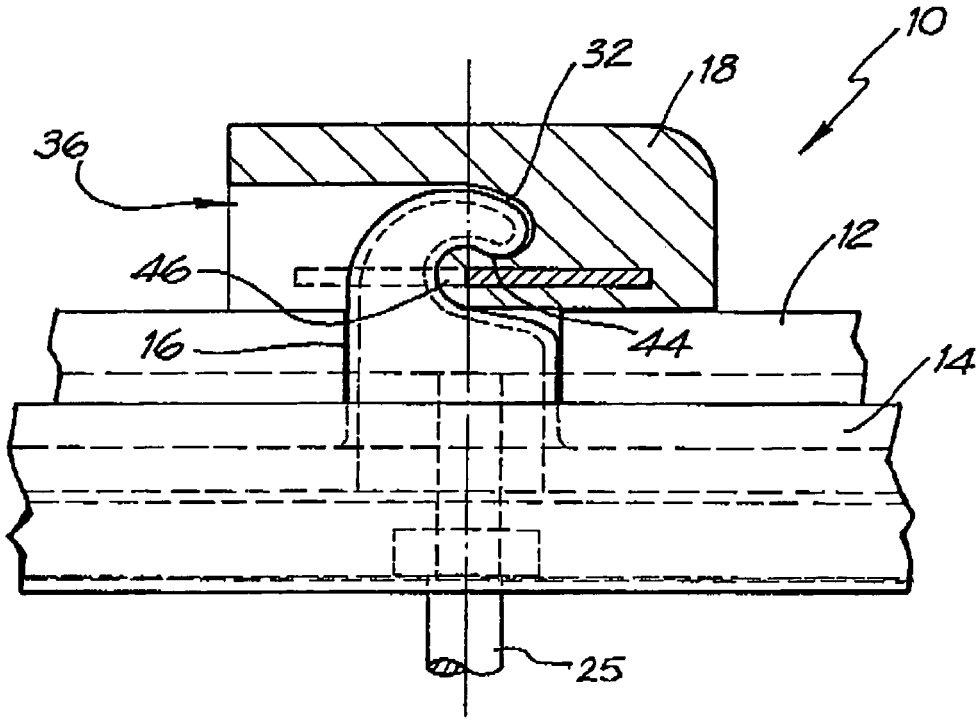
FIG. 8 shows, on an enlarged scale, part of a side view of the assembly of FIG. 5.

In the second example of the first embodiment of the screening assembly illustrated in FIGS. 5 to 8 of the drawings, where, with respect to FIGS. 1 to 4 of the drawings, like reference numerals refer to like parts, the catch member 32 is of curved profile when viewed side on (as shown in FIGS. 7 and 8 of the drawings) to provide a cam-like locking surface 44. This cam-like locking surface 44 of the catch member 32 engages a complementary cam-like locking formation 46 of the locking member 18 to facilitate positive locking of the modules 12 relative to their associated rail 14.

Figure 9:
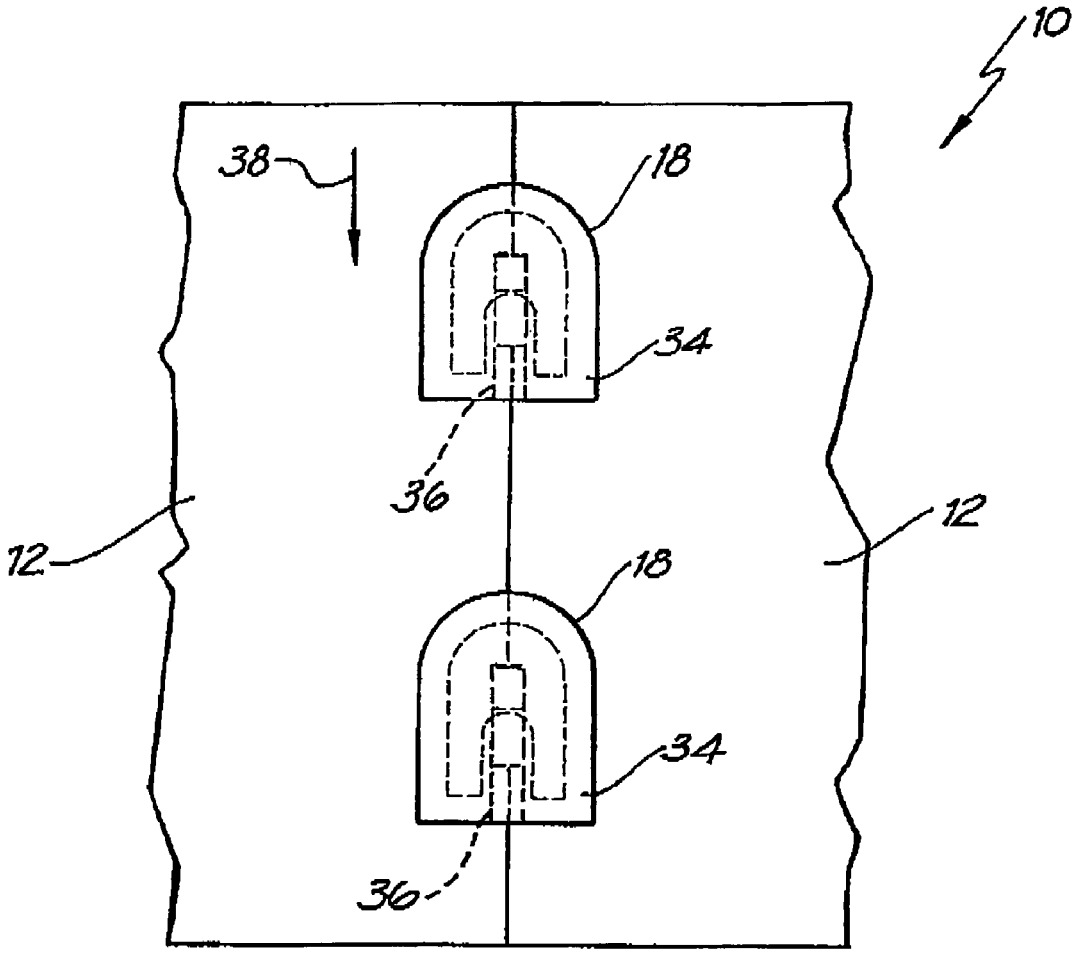
FIG. 9 shows a schematic plan view of a screening assembly in accordance with a third example of the first embodiment of the invention.
Figure 10:
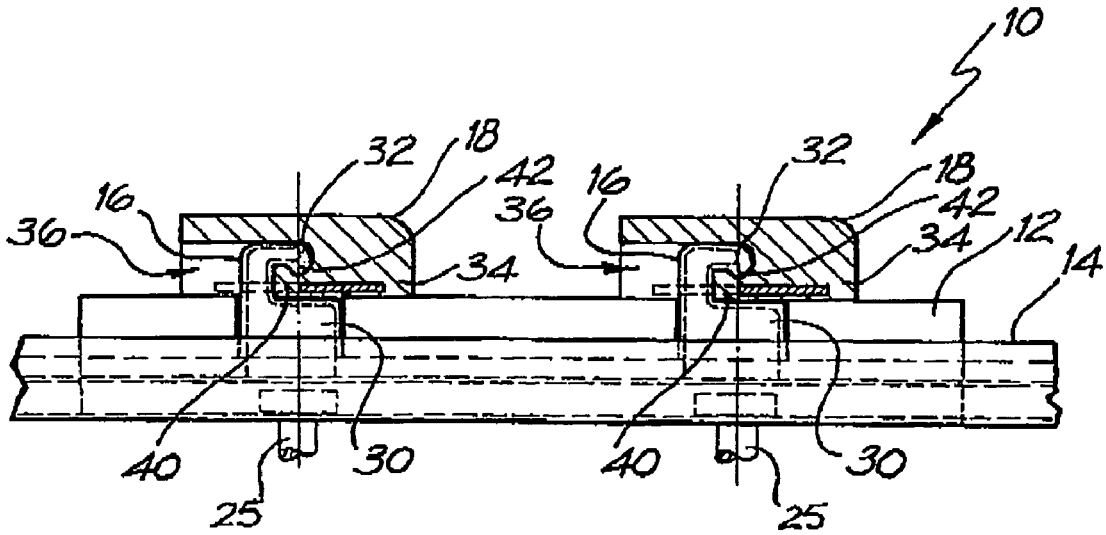
FIG. 10 shows a schematic side view of the assembly of FIG. 9.

In the third example of the first embodiment of the assembly 10 illustrated in FIGS. 9 and 10 of the drawings, each pair of abutting modules 12 is secured to its associated rail 14 by a pair of locating formations 16, each with its associated locking member 18.

In the example illustrated in FIGS. 9 and 10 of the drawings, the catch member 32 of each locating formation 16 has the hook with the downwardly extending tip 42.

Figure 11:
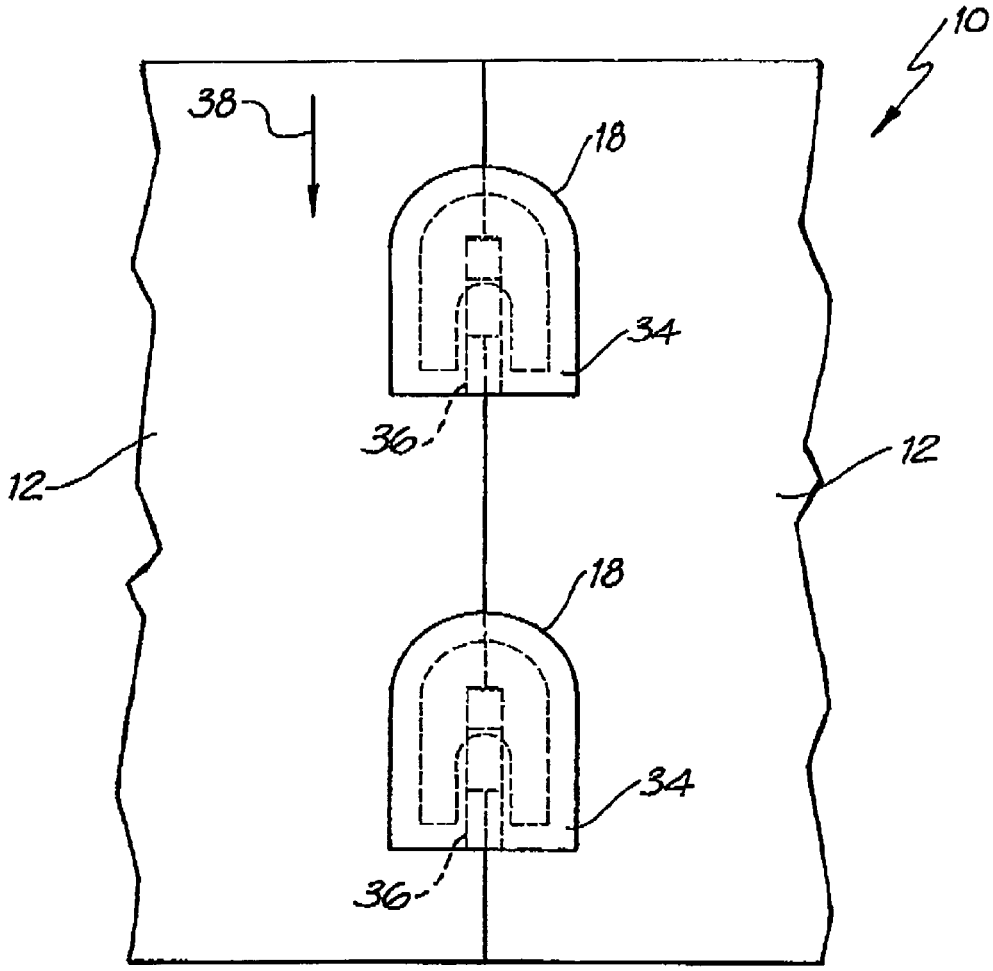
FIG. 11 shows a schematic plan view of a screening assembly in accordance with a fourth example of the first embodiment of the invention.
Figure 12:
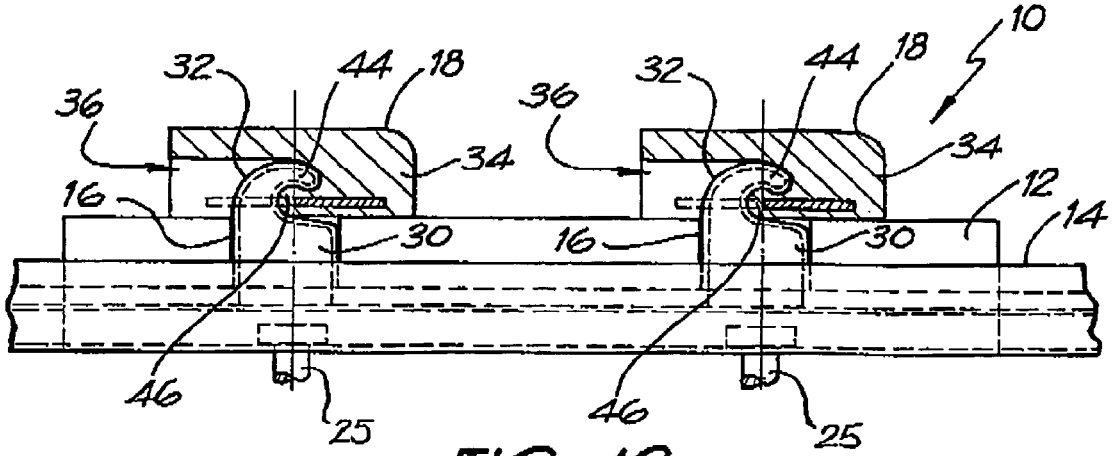
FIG. 12 shows a schematic side view of the assembly of FIG. 11.
Figure 13:
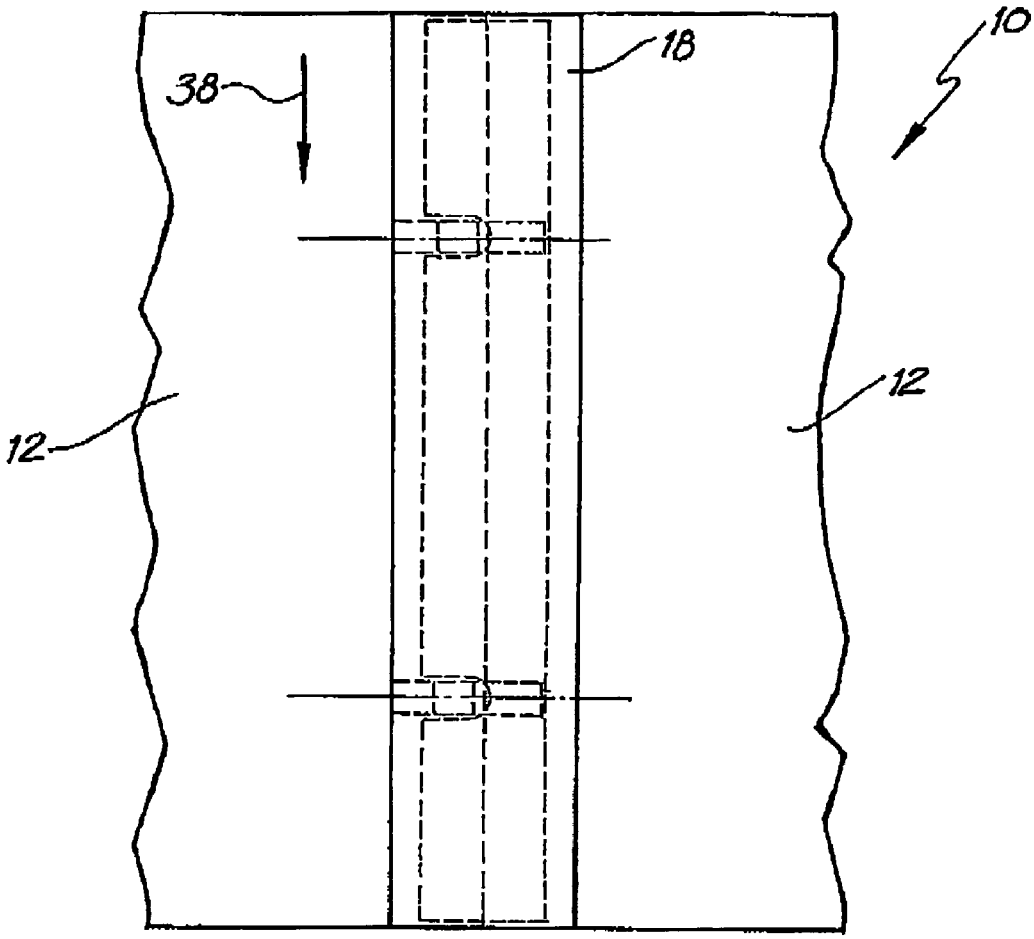
FIG. 13 shows a schematic plan view of a screening assembly in accordance with a second embodiment of the invention.
Figure 14:
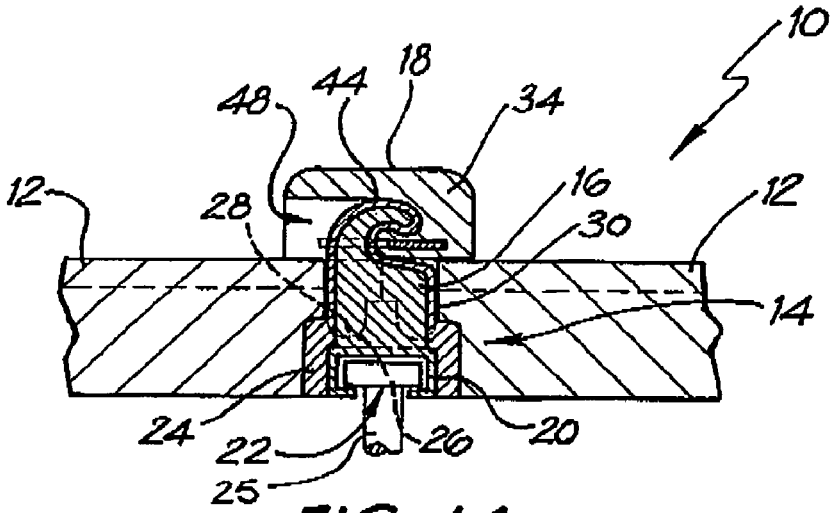
FIG. 14 shows a schematic end view of the assembly of FIG. 13.
Figure 15:
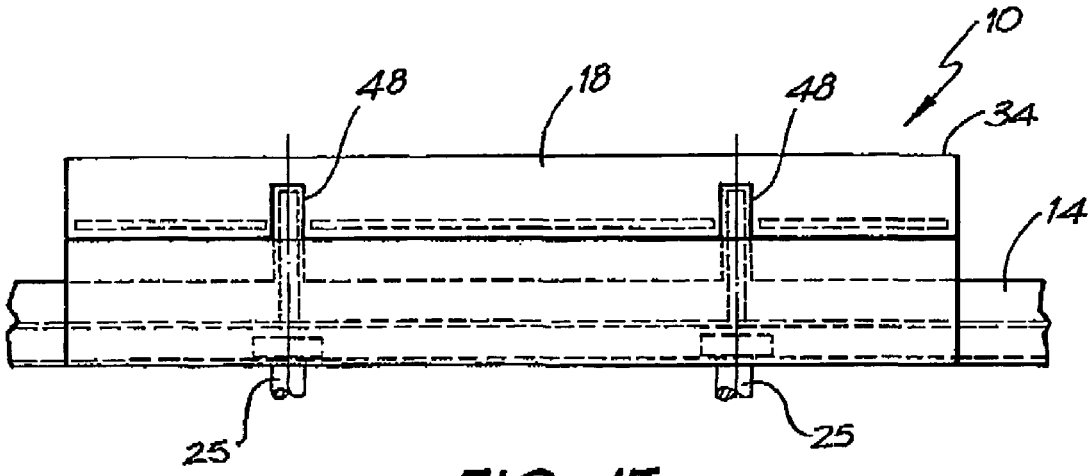
FIG. 15 shows a schematic side view of the assembly of FIG. 13.
Figure 16:
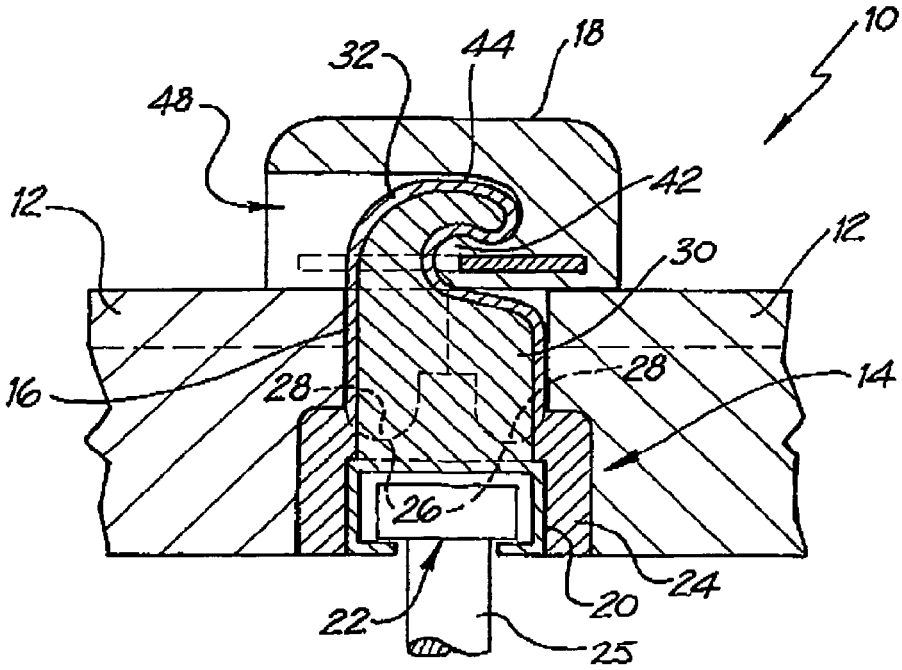
FIG. 16 shows, on an enlarged scale, a part of a schematic end view of the assembly of FIG. 13.

In the example of the invention illustrated in FIGS. 11 and 12 of the drawings, once again, each pair of modules 12 is secured to its associated rail 14 by a pair of locating formations, each with its associated locking member 18. In this example, the catch member 32 of each locating formation 16 has the curved, cam-like profile with the locking formation 46 of each locking member 18 having the complementarily curved shape.

In all the examples of the first embodiment of the invention illustrated in FIGS. 1 to 12 of the drawings, the plate-like structure of the, or each, locating formation is arranged so that longer sides of the plate-like structure extend parallel to the direction of flow of material as illustrated by the arrow 38.

Referring now to FIGS. 13 to 16 of the drawings, a second embodiment of the invention is illustrated. Once again, with reference to the previous drawings, like reference numerals refer to like parts, unless otherwise specified.

In this embodiment of the invention, the plate-like structure 30 of each locating formation 16 is arranged on the intermediate rail 14 with longer sides of the plate-like structure 30 of each locating formation 16 extending at right angles to a direction of flow of material over the screening modules 12.

It is further to be noted that, in this embodiment of the invention, the pairs of modules 12 are secured to their associated intermediate rail 14 by at least two locating formations. However, in contrast to the first embodiment of the invention described above, use is made of a single locking member 18 which has a length approximately the same as that of the ends of modules 12 and which engages the two locating formations 16 for securing the modules 12 to their associated intermediate rail 14. Thus, a pair of slots 48 open into a side of the body member 34 of the locking member 18. The locking member 18 is slid into position relative to the locating formation 16 in a direction at right angles to the direction of flow of material over the screening modules 12.

It is to be noted that the illustrated embodiment uses locating formations 16 where the catch member 32 has the curved, cam-like profile. It will, however, be readily appreciated that the catch member 32 could have the hook-shape as illustrated, for example in FIG. 3 of the drawings.

All of the components of the screening assembly 10 are made of a metal-reinforced polyurethane material. However, the hardness of the polyurethane from which the rails 14, the locating formations 16 and the locking members 18 are made is harder than the polyurethane from which the modules 12 are made so that binding of the modules 12 with respect to the rails 14, locating formations 16 and locking members 18 is inhibited. For example, the modules 12 may be made from a polyurethane having a Shore Hardness of 85–93A whereas the polyurethane from which the locking members 18, the locating formations 16 and the rails 14 are made may have a Shore Hardness of 95A or a Shore D-scale Hardness of 60–65.

It is an advantage of the invention that a screening assembly 10 is provided which achieves positive locking of the screening modules 12 to their associated intermediate rails 14 without the need for any specialised tools. In the embodiments illustrated in FIGS. 1 to 12 of the drawings, the slot 36 of the locking member 18 is arranged at a downstream end of the locking member 18. As a result, the applicant believes that blinding of the slot 36 is unlikely. Even were blinding of the slot 36 to occur, merely knocking the locking member 18, from the downstream end, by means of a hammer, or other similar implement will clear the slot 36 and allow removal of the locking member 18 so that the modules 12 can be removed and replaced. Similarly, with the embodiment illustrated in FIGS. 13 to 16 of the drawings, if the slots 48 were blinded by material, merely knocking the locking member from the side into which the slots 48 open out should facilitate removal of the locking member 18 to release the screening modules 12 to allow them to be replaced.

It is a particular advantage of the invention that positive locking of the screening modules 12 to the rails 14 is facilitated by means of a system which does not require any specialised installation tools. Also, the use of the locking members 18 allows rapid removal and replacement of the screening modules 12 thereby reducing down time of the screening machine.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A screening assembly which includes:

at least one rail to be secured, in use, to a support member of a screening machine to lie intermediate and parallel to side members of the screening machine;

at least one locating formation extending from an operatively upper surface of said at least one rail, the at least one locating formation including a catch member;

a plurality of screening modules, each screening module having an end supported on the at least one rail with a pair of modules lying in end-to-end abutting relationship with each other with the abutting ends overlying the at least one rail, at least one recess being defined in the end of the screening module to be supported on the rail, the recess extending between an operatively upper surface and an operatively lower surface of the end of the screening module with the part of the recess of one module being in register with a corresponding part of the recess of the abutting module to define a passage through which the locating formation passes so that at least the catch member of the locating formation protrudes beyond the upper surface of the abutting screening modules; and a locking member associated with the at least one locating formation for engaging the catch member of said locating formation for locking the pair of modules with respect to each other and with respect to the rail.

2. The screening assembly according to claim 1, in which each rail is in the form of a length of hollow box-section beam with a longitudinally extending slot defined in an operatively lower face of the beam.

3. The screening assembly according to claim 2, in which the beam has a coating of a plastics material.

4. The screening assembly according to claim 3, in which the plastics coating has a pair of spaced, parallel, longitudinally extending grooves defined in an operatively upper surface.

5. The screening assembly according to claim 4, in which each end of each module has a bead extending along an operatively lower surface, the bead being received in one of the grooves for effecting lateral location of the module relative to the rail.

6. The screening assembly according to claim 1, in which each locating formation is in the form of a plate structure which extends upwardly from an operatively upper surface of the rail.

7. The screening assembly according to claim 6, in which the catch member of each locating formation is formed in a free end of the plate structure.

8. The screening assembly according to claim 6, in which each locating formation is arranged on its associated rail with longer sides of the plate structure extending parallel to a direction of flow of material over the screening modules.

9. The screening assembly according to claim 8, in which each locating formation has a locking member associated with it and an upstream end of the locking member is rounded to act as a deflector for deflecting any material to be screened.

10. The screening assembly according to claim 9, in which a slot opens out into a downstream end of the locking member into which the catch member of the locating formation is received to enable the catch member to engage the complementary locking formation of the locking member.

11. The screening assembly according to claim 6, in which the plate structure of each locating formation is arranged at substantially right angles to a direction of flow of material over the screening modules.

12. The screening assembly according to claim 11, in which each screening module has at least two locating formations associated with each end and a single locking member, which has a length substantially the same as each end of the screening module, engages both locating formations.

13. The screening assembly according to claim 11, in which the locating formations are arranged at right angles to the direction of flow of material and one locking member is associated with at least two locating formations, slots opening out into a side of the locking member so that the locking member is slid into position relative to the locating formations in a direction at right angles to the direction of flow of material over the screening modules.

14. The screening assembly according to claim 1, in which the catch member of each locating formation is substantially hook-shaped.

15. The screening assembly according to claim 14, in which the catch member is in the form of a hook having a downwardly extending tip for engaging a complementary locking formation of the locking member to effect positive locking of the screening modules to the rail.

16. The screening assembly according to claim 1, in which the catch member has a substantially curved shape which engages a similarly curved, but oppositely directed, locking formation of the locking member to effect positive locking of the screening modules to the rail.

17. The screening assembly according to claim 1, in which an operatively lower peripheral edge of each locking member has an outwardly flared portion which acts as a skirt and bears against upper surfaces of the associated screening modules for inhibiting the ingress of detritus between the bottom of the locking member and the upper surfaces of the modules.

18. The screening assembly according to claim 1, in which each screening module is substantially rectangular when viewed in plan and shorter sides of the screening modules are arranged in the direction of flow of material over the screening modules.

19. The screening assembly according to claim 1, in which the modules and the locking members are of a reinforced synthetic plastics material.

20. The screening assembly according to claim 19, in which the plastics material is polyurethane.

21. The screening assembly according to claim 20, in which the hardness of the polyurethane used for the locking member differs from that of the modules for inhibiting binding of the locking member relative to its associated modules.

22. The screening assembly according to claim 21, in which the locking member is of a harder polyurethane than the modules.

23. A screening module for a screening assembly, the screening module including:

a module body having a pair of opposed ends;

at least one recess defined in at least one of the ends of the module body and extending between an operatively upper surface and an operatively lower surface of the at least one end of the module body, the recess, in use, mating with a corresponding part of a recess of a module body of an identical module arranged in end-to-end abutment to define a passage, arranged transversely to a top surface of the body member, through which a locating formation of the screening assembly passes, in use; and a retaining formation arranged along the operatively lower surface of at least one of the ends of the module body, the retaining formation being received in a complementary formation of an underlying rail of the screening assembly, in use, for locating the module body with respect to the rail.

24. The screening module according to claim 23, in which each end of the module body is stepped at its lower edge to overlie an associated rail of the screening assembly.

25. The screening module according to claim 24, in which the retaining formation is arranged intermediate an end of the module body and an operatively vertical part of the step.

26. An intermediate rail for a screening assembly, the intermediate rail including:

a hollow, elongate element to be secured to an underlying support member of a screening machine by a plurality of spaced fasteners, the elongate element defining a channel running essentially throughout and having a longitudinally extending slot defined in an operatively lower surface thereof so that heads of the fasteners can be displaceably received within the channel of the elongate element with shanks of the fasteners protruding through the slot; and at least one locating formation standing proud of an operatively upper surface of the elongate element, the, or each, locating formation including a catch member.

27. The intermediate rail according to claim 26, in which the elongate element and the at least one locating formation is covered with a synthetic plastics material.

28. A locking member for a screening assembly, the locking member including:

a body member having at least one open ended slot defined therein, the at least one slot being defined by a pair of opposed walls extending operatively upwardly from a bottom of the body member, a spacing between the walls being uniform throughout a height of the slot and the slot opening out into a side of the body member; and a locking formation arranged in the at least one slot to be engaged by a catch member of a locating formation of the screening assembly when the catch member is received in the slot, in use.

* * * * *